United States Patent [19]

LaSpisa

[11] Patent Number: 4,557,686

[45] Date of Patent: Dec. 10, 1985

[54] CONTROL OF THE FLOW OF FUEL TO MULTIPLE BURNERS

[75] Inventor: Ronald J. LaSpisa, Bartlesville, Okla.

[73] Assignee: Phillips Petroleum Company, Bartlesville, Okla.

[21] Appl. No.: 631,367

[22] Filed: Jul. 16, 1984

[51] Int. Cl.[4] ..... F23D 13/20

[52] U.S. Cl. ..... 431/5; 431/12; 431/90; 110/348; 364/502; 364/510; 126/351

[58] Field of Search ..... 431/5, 12, 4, 89, 90; 236/15 BD, 15 E; 110/348; 422/110; 364/500, 502, 510; 126/351

[56] References Cited

U.S. PATENT DOCUMENTS

| | | | |
|---|---|---|---|
| 3,049,300 | 8/1962 | Lewis et al. | 431/12 X |
| 3,211,372 | 10/1965 | Hamilton, Jr. | 236/15 E |
| 3,387,589 | 6/1968 | Chan et al. . | |
| 3,566,241 | 2/1971 | Ross | 318/624 |
| 3,774,396 | 11/1973 | Borsi et al. | 60/106 |
| 3,777,547 | 4/1968 | Ohlson . | |
| 4,003,342 | 1/1977 | Hodgson | 122/448 R |
| 4,067,684 | 1/1978 | McInerney | 431/90 X |
| 4,147,159 | 4/1979 | Thorwaldson | 126/351 |
| 4,268,784 | 5/1981 | Ganaway | 318/610 |
| 4,304,249 | 12/1981 | White | 137/94 |
| 4,359,284 | 11/1982 | Kude et al. | 422/98 X |
| 4,459,098 | 7/1984 | Turek et al. | 431/12 |

*Primary Examiner*—Randall L. Green

*Attorney, Agent, or Firm*—French and Doescher

[57] ABSTRACT

The flow of offgas from a common source as a fuel for multiple boilers is controlled so as to maintain a desired minimum pressure for the offgas supply unless the maintenance of such a desired minimum pressure would result in so much offgas being supplied to a boiler that a maximum offgas to fuel gas ratio is exceeded which impairs combustion. If the primary control would cause too much offgas to be supplied to a boiler, then the flow of offgas to such boiler is manipulated so as to prevent the maximum offgas to fuel gas ratio from being exceeded.

10 Claims, 3 Drawing Figures

CONTROL OF THE FLOW OF FUEL TO MULTIPLE BURNERS

This invention relates to control of a process in which an offgas from a single source is supplied as a fuel to multiple burners.

Many processes produce a waste gas (also referred to as an offgas) which has a hydrocarbon content and thus would produce heat if combusted. However, the BTU content of such offgases generally varies widely.

Environmental considerations make it unfeasible to simply vent the offgas to dispose of it. Also, increasing cost of fuel have made it desirable to recover the BTU content where possible. One method which has been used to accomplish the disposal of offgas and to also recover the BTU content is to use the offgas as a feed gas to the burners associated with apparatus such as a boiler.

It is difficult to supply offgas directly to a burner because the BTU content may vary substantially over relatively short periods of time. Also, in some cases, the BTU content is so low as to preclude combustion. Thus, it is generally necessary to mix the offgas with fuel gas having a substantially constant BTU content with the resulting mixture being supplied to the burner. The mixing is accomplished so as to insure that an offgas to fuel gas ratio which would impair combustion is not exceeded.

Where the offgas is supplied from a single source or pipeline, it is sometimes difficult to use the offgas as a fuel for burners associated with multiple apparatus without violating process constraints such as offgas to fuel gas ratios or a minimum pressure for the offgas supply. It is thus an object of this invention to provide method and apparatus for controlling a process in which an offgas is supplied from a single source as a fuel to a plurality of burners so as to combust as much of the offgas as is possible without violating a process constraint associated with the apparatus using the burners or the offgas supply.

In accordance with the present invention, the flow of the offgas to all burners associated with multiple apparatus is manipulated so as to maintain a desired minimum pressure for the offgas supply unless the maintenance of such a desired minimum pressure would result in so much offgas being supplied to a burner that a maximum offgas to fuel gas ratio is exceeded which impairs combustion. If the primary control would cause too much offgas to be supplied to a burner, then the flow of offgas to such burner is manipulated so as to prevent the maximum offgas to fuel gas ratio from being exceeded. Thus, the flow of offgas to the multiple burners is substantially maximized unless such maximization would result in the violation of a process constraint (maximum offgas to fuel gas ratio).

Other objects and advantages of the invention will be apparent from the foregoing brief description of the invention and the claims as well as the detailed description of the drawings which are briefly described as follows:

The invention is described in terms of the burners associated with two boilers. However, the invention is applicable to supplying offgas as fuel to burners associated with apparatus other than boilers. Also, the invention is applicable to systems employing more than two boilers or other apparatus having burners associated therewith.

The present invention was applied in a plant in which the offgas was withdrawn from a polyethylene reactor. The invention will be described in terms of such an offgas. However, the invention is applicable to the use of other offgases and is also applicable to plants in which a plurality of offgases from multiple sources are mixed to form a single offgas source.

Figure 1:
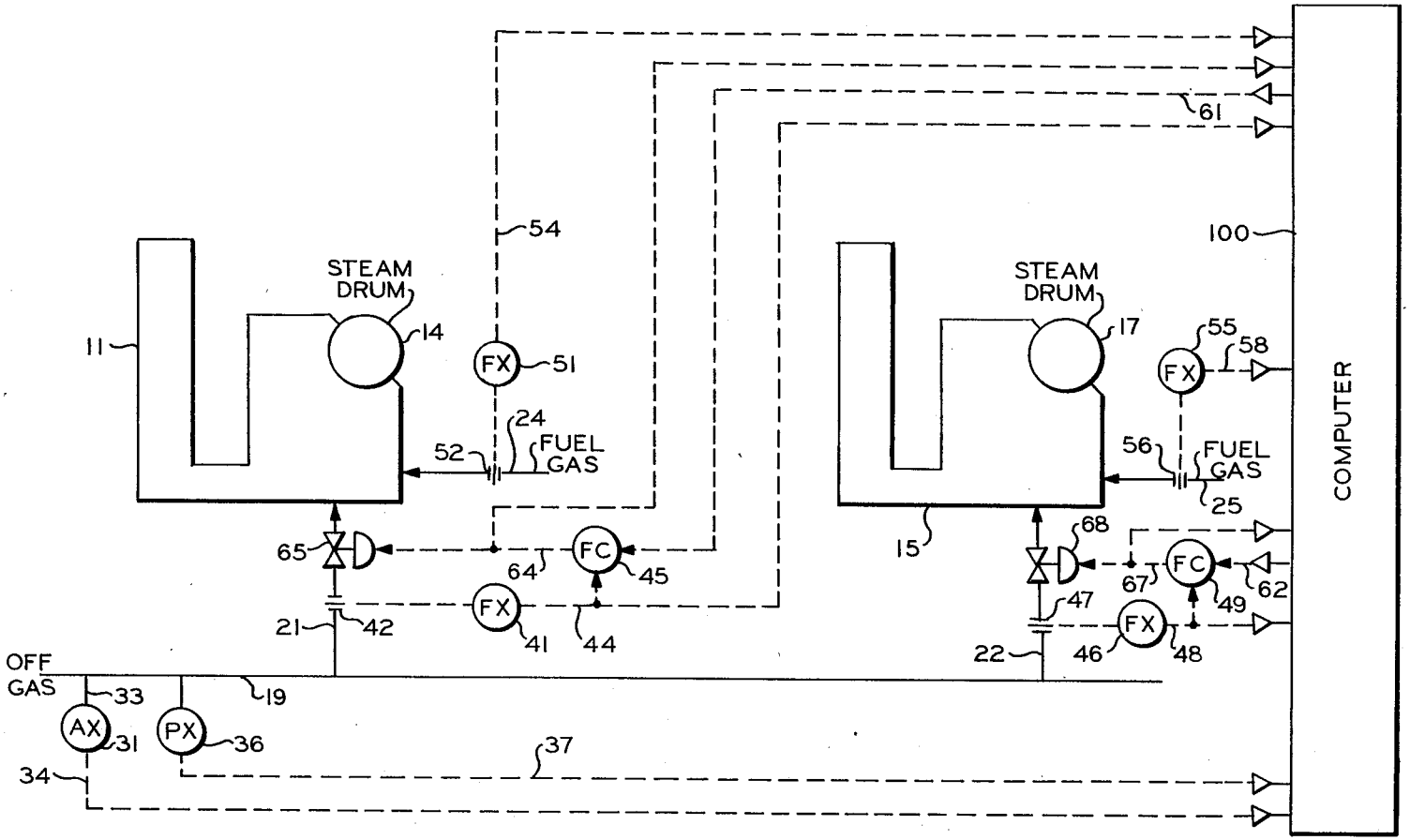
FIG. 1 is a diagrammatic illustration of two boilers which are supplied offgas from a single source as a fuel and the associated control system of the present invention.

A specific control system configuration is set forth in FIG. 1 for the sake of illustration. However, the invention extends to different types of control system configurations which accomplish the purpose of the invention. Lines designated as signal lines in the drawings are electrical or pneumatic in this preferred embodiment. Generally, the signals provided from any transducer are electrical in form. However, the signals provided from flow sensors will generally be pneumatic in form. Transducing of these signals is not illustrated for the sake of simplicity because it is well known in the art that, if a flow is measured in pneumatic form, it must be transduced to electrical form if it is to be transmitted in electrical form by a flow transducer. Also, transducing of the signals from analog form to digital form or from digital form to analog form is not illustrated because such transducing is also well known in the art.

The invention is also applicable to mechanical, hydraulic or other signal means for transmitting information. In almost all control systems some combination of electrical, pneumatic, mechanical or hydraulic signals will be used. However, use of any other type of signal transmission, compatible with the process and equipment in use, is within the scope of the invention.

A digital computer is used in the preferred embodiment of this invention to calculate the required control signals based on measured process parameters as well as set points supplied to the computer. Analog computers or other types of computing devices could also be used in the invention. The digital computer is preferably an OPTROL 7000 Process Computer System from Applied Automation, Inc., Bartlesville, Okla.

Signal lines are also utilized to represent the results of calculations carried out in a digital computer and the term "signal" is utilized to refer to such results. Thus, the term signal is used not only to refer to electrical currents or pneumatic pressures but is also used to refer to binary representations of a calculated or measured value.

The controllers shown may utilize the various modes of control such as proportional, proportional-integral, proportional-derivative, or proportional-integral-derivative. In this preferred embodiment, proportional-integral-derivative controllers are utilized but any controller capable of accepting two input signals and producing a scaled output signal, representative of a comparison of the two input signals, is within the scope of the invention.

The scaling of an output signal by a controller is well known in control system art. Essentially, the output of a controller may be scaled to represent any desired factor or variable. An example of this is where a desired flow rate and an actual flow rate is compared by a controller. The output could be a signal representative of a desired change in the flow rate of some gas necessary to make the desired and actual flows equal. On the other hand, the same output signal could be scaled to represent a percentage or could be scaled to represent a temperature change required to make the desired and actual flows equal. If the controller output can range from 0 to 10 volts, which is typical, then the output signal could be scaled so that an output signal having a voltage level of 5.0 volts corresponds to 50 percent, some specified flow rate, or some specified temperature.

Two controllers shown also preferably include a select feature. This is a wellknown feature in process control for preventing reset windup. Essentially, such controllers accept a tracking variable signal in addition to the normal process variable and set point input signals. The tracking variable signal is used as a reset signal to prevent windup when the output of the controller is not selected.

The various transducing means used to measure parameters which characterize the process and the various signals generated thereby may take a variety of forms or formats. For example, the control elements of the system can be implemented using electrical analog, digital electronic, pneumatic, hydraulic, mechanical or other similar types of equipment or combinations of one or more such equipment types. While the presently preferred embodiment of the invention preferably utilizes a combination of pneumatic final control elements in conjunction with electrical analog signal handling and translation apparatus, the apparatus and method of the invention can be implemented using a variety of specific equipment available to and understood by those skilled in the process control art. Likewise, the format of the various signals can be modified substantially in order to accommodate signal format requirements of the particular installation, safety factors, the physical characteristics of the measuring or control instruments and other similar factors. For example, a raw flow measurement signal produced by a differential pressure orifice flow meter would ordinarily exhibit a generally proportional relationship to the square of the actual flow rate. Other measuring instruments might produce a signal which is proportional to the measured parameter, and still other transducing means may produce a signal which bears a more complicated, but known, relationship to the measured parameter. Regardless of the signal format or the exact relationship of the signal to the parameter which it represents, each signal representative of a measured process parameter or representative of a desired process value will bear a relationship to the measured parameter or desired value which permits designation of a specific measured or desired value by a specific signal value. A signal which is representative of a process measurement or desired process value is therefore one from which the information regarding the measured or desired value can be readily retrieved regardless of the exact mathematical relationship between the signal units and the measured or desired process units.

Referring now to the drawings and in particular to FIG. 1, there is illustrated a boiler 11 having a steam drum 14 and a burner system associated therewith. There is also illustrated a boiler 15 having a steam drum 17 and a burner system associated therewith. Steam from the steam drum 14 and steam drum 17 would typically be supplied to a steam header and thus to various processes in the plant.

Offgas is supplied through conduit 19 from a polyethylene reactor. Primary components of the offgas are methane, ethane, iso-butane, ethylene, hydrogen and nitrogen. The offgas heating value typically varies between 970 and 1500 BTU/SCF. A portion of the offgas flowing through conduit 19 is withdrawn through conduit 21 and is supplied to the burners associated with the boiler 11. Also, offgas is withdrawn through conduit 22 and supplied to the burners associated with the boiler 15.

Fuel gas is supplied to the burners associated with the boiler 11 through conduit 24. Fuel gas is supplied to the burners associated with the boiler 15 through conduit 25. The same or different fuel gases may be used. The fuel gas would typically have a heating value of about 1000 BTU/SCF.

Air would also be supplied to the burners associated with the boilers 11 and 15. Also, additional control would typically be applied such that a desired air to fuel ratio would be maintained at the burners. However, since such additional streams, such as air, and additional control are not required for a description of the present invention, such additional streams and additional control have not been illustrated for the sake of simplicity. Also, additional equipment such as pumps and additional analyzers which would typically be associated with a boiler process have not been illustrated since these additional components play no part in the description of the present invention.

In general, control of the boilers 11 and 15 is accomplished by using process measurements to establish two control signals. The process measurements will first be described and then the use of the control signals will be described. Thereafter, the manner in which the process measurements are utilized to generate the control signals will be described.

Analyzer transducer 31 is in fluid communication with conduit 19 through conduit 33. Based on an analysis of the offgas flowing through conduit 19, analyzer transducer 31 provides an output signal 34 which is representative of the heating value (BTU content) of the offgas flowing through conduit means 19. Signal 34 is provided from the analyzer transducer 31 as an input to computer 100. The analyzer transducer 31 may be an Optichrom 2100 Analyzer by Applied Automation, Bartlesville, Okla.

The BTU content of the offgas may vary considerably. Thus, it is desirable to use an analyzer to determine the BTU content. However, for some processes, the BTU content will remain relatively constant when a particular type of product is being produced. Thus, if desired, the BTU content of the offgas for particular process conditions can be determined and entered into a computer. The operator would then inform the computer of such process conditions at any particular time. This would avoid the expense of the analyzer 31 but would cause some decrease in accuracy and would also require operator intervention.

Pressure transducer 36 in combination with a pressure sensing device, which is operably located in conduit 19, provides an output signal 37 which is representative of the actual pressure of the offgas. This pressure may vary considerably over a period of time. Signal 37 is provided from the pressure transducer 36 as an input to computer 100.

Flow transducer 41 in combination with a flow sensor 42, which is operably located in conduit 21, provides an output signal 44 which is representative of the actual flow rate of the offgas flowing through conduit 21. Signal 44 is provided from the flow transducer 41 as the process variable input to the flow controller 45 and is also provided as an input to computer 100.

In like manner, flow transducer 46 in combination with the flow sensor 47, which is operably located in conduit 22, provides an output signal 48 which is representative of the actual flow rate of the offgas flowing through conduit 22. Signal 48 is provided from the flow transducer 46 as the process variable input to the flow controller 49 and also as an input to computer 100.

Flow transducer 51 in combination with the flow sensor 52, which is operably located in conduit 24, provides an output signal 54 which is representative of the actual flow rate of fuel gas through conduit 24. Signal 54 is provided from the flow transducer 51 as an input to computer 100.

In like manner, flow transducer 55 in combination with the flow sensor 56, which is operably located in conduit 25, provides an output signal 58 which is representative of the actual flow rate of the fuel gas through conduit 25. Signal 58 is provided from the flow transducer 55 as an input to computer 100.

In response to the described process measurements and other set point signals and anti-reset windup signals which will be described hereinafter, two control signals 61 and 62 are generated by computer 100. The use of these control signals to control the process illustrated in FIG. 1 is as follows:

Signal 61 is representative of the desired flow rate of offgas through conduit 21. Signal 61 is provided as the set point input to the flow controller 45.

In response to signals 44 and 61, the flow controller 45 provides an output signal 64 which is responsive to the difference between signals 44 and 61. Signal 64 is scaled so as to be representative of the position of the control valve 65, which is operably located in conduit 21, required to maintain the actual flow rate of offgas through conduit 21 substantially equal to the desired flow rate represented by signal 61. Signal 64 is provided as a control signal to control valve 65 and control valve 65 is manipulated in response thereto. Signal 64 is also provided as an anti-reset windup signal to computer 100 and is utilized for anti-reset windup purposes as will be described more fully hereinafter.

Signal 62 is representative of the desired flow rate of offgas through conduit 22. Signal 62 is provided as the set point input to the flow controller 49.

In response to signals 48 and 62, the flow controller 49 provides an output signal 67 which is responsive to the difference between signals 48 and 62. Signal 67 is scaled so as to be representative of the position of the control valve 68, which is operably located in conduit 22, required to maintain the actual flow rate of offgas through conduit 22 substantially equal to the desired flow rate represented by signal 62. Signal 67 is provided as a control signal to control valve 68 and control valve 68 is manipulated in response thereto. Signal 67 is also provided as an anti-reset windup signal to computer 100 and is utilized for anti-reset windup purposes as will be described more fully hereinafter.

Figure 2:
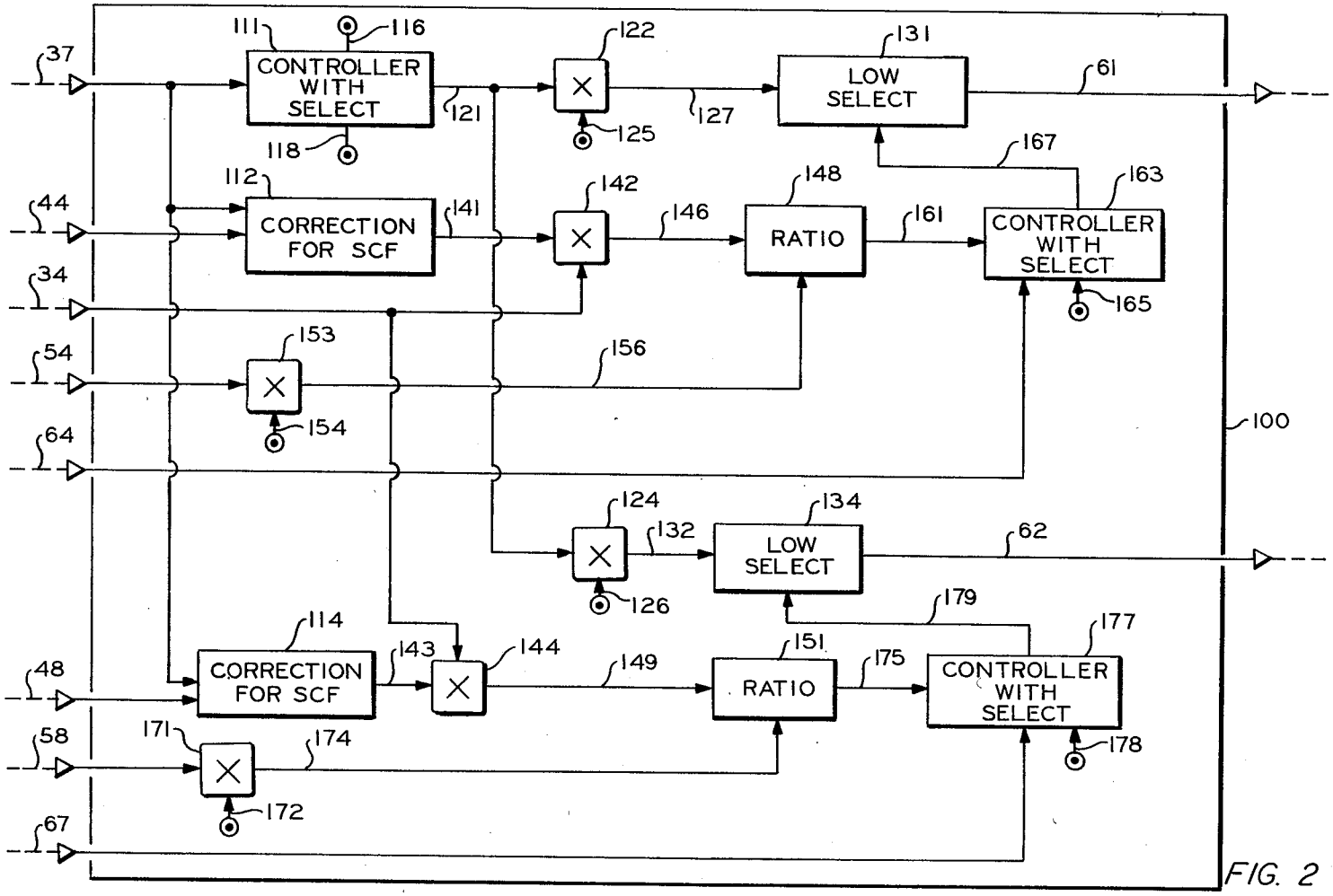
FIG. 2 is a flow diagram of the computer logic utilized to generate the control signals illustrated in FIG. 1 based on the process measurements illustrated in FIG. 1.

Referring now to FIG. 2, signal 37, which is representative of the actual pressure of the offgas in conduit 19, is supplied as the process variable input to the controller with select 111 and is also supplied as an input to the correction for standard cubic feet block 112 and 114. The controller with select 111 is also supplied with a set point signal 116 which is representative of the minimum desired pressure for the offgas in conduit 19. Typically, this minimum desired pressure is determined by some process constraint associated with the process or processes which are generating the offgas. Maintaining the offgas pressure at the minimum pressure will result in a substantially maximum usage of the offgas without violating a minimum pressure constraint.

The controller with select 111 is also provided with an anti-reset windup signal 118 at the select input. The manner in which signal 118 is generated and utilized will be described more fully hereinafter.

In response to signals 37 and 116, the controller 111 provides an output signal 121 which is responsive to the difference between signals 37 and 116. Signal 121 is scaled so as to be representative of the total amount of offgas which must be withdrawn from conduit 19 in order to maintain the actual pressure in conduit 19 substantially equal to the desired minimum pressure represented by signal 116. Signal 121 is supplied from the controller 111 as an input to the multiplying block 122 and as an input to the multiplying block 124.

The output from controller 111 affects the control of both boilers. Controller 111 is thus generally considered a master or plant controller as opposed to a dedicated controller which affects the control of only one boiler.

Multiplying block 122 is supplied with a bias signal 125 and the multiplying block 124 is supplied with a bias signal 126. These bias signals are utilized to divide the flow of offgas between the two boilers 11 and 15.

If the amount of offgas which can be handled by the boilers 11 and 15 is equal, then both the bias signal 125 and the bias signal 126 will be representative of 50 percent. However, if the boilers have different capacities for combusting fuel, different burn rates or other different characteristics, the bias signals 125 and 126 are utilized to divide the fuel unequally. As an example, 40 percent of the offgas might be supplied to boiler 11 by setting signal 125 at 40 percent while 60 percent could be supplied to boiler 15 by setting bias signal 126 at 60 percent.

Signal 121 is multiplied by signal 125 to establish signal 127 which is representative of the flow rate of offgas to the burners associated with the boiler 11 required to maintain a minimum desired offgas pressure assuming that the appropriate amount of offgas is also supplied to boiler 15. Signal 127 is supplied from the multiplying block 122 as a first input to the low select block 131.

In like manner, signal 121 is multiplied by signal 126 to establish signal 132 which is representative of the flow rate of offgas to the boiler 15 required to maintain the desired minimum offgas pressure. Again, the magnitude of signal 132 assumes that the appropriate amount of offgas is being supplied to boiler 11. Thus, the sum of signals 127 and 132 should be equal to the magnitude of signal 121. Signal 132 is provided from the multiplying block 124 as the first input to the low select block 134.

Signal 44, which is representative of the actual flow rate of the offgas through conduit 21, is provided as a second input to the correction for standard cubic feet block 111. In like manner, signal 48, which is representative of the flow rate of offgas through conduit 22, is provided as a second input to the correction for standard cubic feet block 114.

As has been previously stated, the offgas pressure is subject to substantial variation. Because of this it is desirable to apply a correction factor to the outputs of the flow transducers 41 and 46 to convert such outputs to flow in standard cubic feet. For the particular process to which the present invention was applied, the flow transducer 41 was calibrated at 11.3 psig. The correction factor applied to give $OG_{SCF}$, which is representative of the actual flow rate of the offgas in standard cubic feet per hour, is given by equation 1.

$$OG_{SCF} = \left(\sqrt{\frac{P + 14.7}{26}}\right)(OG_m) \quad (1)$$

where

P = the offgas pressure (signal 37); and $OG_m$ = the actual measured offgas flow rate (signal 44 or 48).

Signal 141, which is representative of the actual flow rate of the offgas through conduit 21 in standard cubic feet per hour is provided from the correction for standard cubic feet block 112 as a first input to the multiplying block 142. In like manner, signal 143, which is representative of the actual flow rate of the offgas through conduit 22 in standard cubic feet per hour, is provided from the correction for standard cubic feet block 114 as a first input to the multiplying block 144.

Signal 34, which is representative of the actual BTU content (BTU/SCF) of the offgas is provided as a second input to the multiplying block 142 and is also provided as a second input to the multiplying block 144. Signal 141 is multiplied by signal 34 to establish signal 146 which is representative of the number of BTU's per hour being provided to the boiler 11 by the offgas flowing through conduit 21. Signal 146 is provided from the multiplying block 142 as a first input to the ratio block 148.

In like manner, signal 143 is multiplied by signal 34 to establish signal 149 which is representative of the number of BTUs per hour being provided to the boiler 15 by the offgas flowing through conduit 22. Signal 149 is provided from the multiplying block 144 as a first input to the ratio block 151.

Signal 54, which is representative of the actual flow rate of fuel gas through conduit 24, is provided as a first input to the multiplying block 153. The multiplying block 153 is also provided with a signal 154 which is representative of the BTU content (BTU/SCF) of the fuel gas. Generally, the BTU content of the fuel gas will be known. However, if the BTU content is not known or varies substantially, analysis can be utilized to determine the BTU content.

Signal 54 is multiplied by signal 154 to establish signal 156 which is representative of the number of BTU's per hour being provided to the boiler 11 by the fuel gas flowing through conduit 24. Signal 156 is provided as a second input to the ratio block 148.

If signal 146 is considered $OG_{BTU}$ and signal 156 is considered $FG_{BTU}$, then the output signal 161 from the ratio block 148 is given by $OG_{BTU}/(FG_{BTU}+OG_{BTU})$. Signal 161 is thus representative of the fraction of the total BTU's provided to the boiler 11 which are provided by the offgas. Signal 161 is provided as the process variable input to the controller with select 163.

For any particular set of burners, there will generally be a minimum amount of fuel gas which must be utilized to achieve a proper flame. Stated in another manner, for any particular set of burners, there will be some maximum fraction of the total BTU's which may be supplied by the offgas. For the particular installation for which the present invention was applied, this maximum fraction was 0.40. This maximum fraction is supplied as the set point signal 165 to the controller 163.

In response to signals 161 and 165, the controller 163 provides an output signal 167 which is responsive to the difference between signals 161 and 165. Signal 167 is scaled so as to be representative of the flow rate of offgas through conduit 21, which is illustrated in FIG. 1, required to maintain the actual magnitude of the ratio or fraction represented by signal 161 substantially equal to the maximum ratio represented by signal 165. Signal 167 is provided as a second input to the low select 131.

The one of signal 127 and 167 which is representative of the lowest flow rate of offgas through conduit 21 will be selected to establish signal 61. Signal 61 is provided as an output from the low select 131 and is utilized as has been previously described.

In general, signal 61 will be equal to signal 127. Only in those circumstances where enough offgas is available to enable control based on signal 127 to force the offgas to fuel gas ratio to exceed the maximum represented by signal 165 will signal 167 become the controlling signal. Thus, control is provided whereby substantially maximum usage of the offgas is achieved without violating process constraints.

Signal 58, which is representative of the actual flow rate of fuel gas through conduit 25, is provided as a first input to the multiplying block 171. The multiplying block 171 is also provided with signal 172 which is representative of the BTU content (BTU/SCF) of the fuel gas flowing through conduit 25. If the fuel gas flowing through conduit 25 is the same as the fuel gas flowing through conduit 24, then signal 172 will be equal to signal 154.

Signal 58 is multiplied by signal 172 to establish signal 174 which is representative of the number of BTUs per hour being provided to the boiler 15 by the fuel gas flowing through conduit 25. Signal 172 is provided as a second input to the ratio block 151.

As was the case with ratio block 148, the ratio block 151 establishes an output signal 175 which is representative of the fraction of the total BTUs provided to the boiler 15 which are provided by the offgas. Signal 175 is provided as the process variable input to the controller with select 177.

The controller with select 177 is also provided with a set point signal 178 which is representative of the maximum fraction of the total BTUs provided to the boiler 15 which may be provided by the offgas. Signal 178 would typically be equal to signal 165 but may be different if the burner characteristics of the boilers are different.

In response to signals 175 and 178, the controller 177 provides an output signal 179 which is responsive to the difference between signals 175 and 178. Signal 179 is scaled so as to be representative of the flow rate of offgas through conduit 22 required to maintain the actual magnitude of the ratio or fraction represented by signal 175 substantially equal to the maximum ratio represented by signal 178. Signal 179 is provided as a second input to the low select 134.

As was the case with the low select 131, the one of signals 132 and 179 which is representative of the lowest flow rate of offgas through conduit 22 is selected to establish the magnitude of signal 62. Signal 62 is provided as an output signal from the low select 134 and is utilized as has been previously described.

In any control system where the outputs of two controllers are eventually supplied to a select function with one of the outputs being selected as the control signal, there may be a problem with reset windup. Reset windup refers to the reset or integral action of a controller driving the output off scale whenever a sustained deviation between its set point and process variable signal is imposed.

In the control system of the present invention, reset windup of controllers 163 and 167 is accomplished in a conventional manner by providing the output signal 64 from the flow controller 45 as an anti-reset windup signal to the select input of the controller 163 and by providing the output signal 67 of the controller 49 as the anti-reset windup input to the select input of the controller 177. These signals can be used for anti-reset windup of these controllers because these controllers are associated with the control of only one of the boilers 11 or 15. This type of control of anti-reset windup is well known to those skilled in control art.

A different problem is presented by the master controller 111. This controller is associated with the control of both the boiler 11 and boiler 15. Because of this, conventional anti-reset windup cannot be utilized. A particular advantage of the present invention is the manner in which an anti-reset windup signal 118 is established as is illustrated in FIG. 3.

Figure 3:
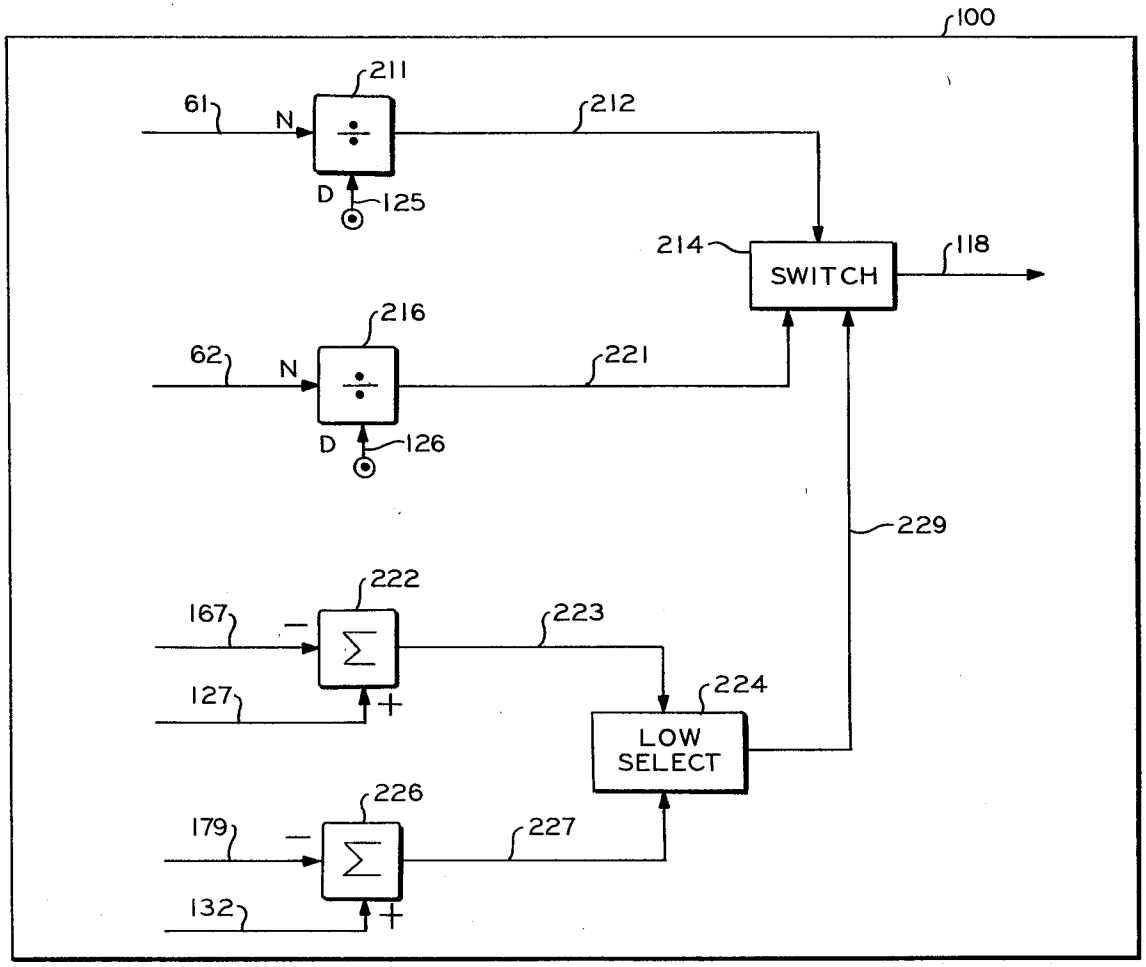
FIG. 3 is a flow diagram of the computer logic utilized to generate the anti-reset windup signal applied to the master controller illustrated in FIG. 2.

Referring now to FIG. 3, signal 61, which is the set point signal applied to the flow controller 45, is supplied to the numerator input of the dividing block 211. Signal 125, which is the bias signal applied to the multiplying block 122, is supplied to the denominator input of the dividing block 211. Signal 61 is divided by signal 125 to establish signal 212. Signal 212 is provided as a first input to the software switch 214.

In like manner, signal 62, which is the set point signal applied to the flow controller 49, is supplied to the numerator input of the dividing block 216. Signal 126, which is the bias input applied to the multiplying block 124, is supplied to the denominator input of the dividing block 216. Signal 62 is divided by signal 126 to establish signal 221. Signal 221 is provided as a second input to the software switch 214.

Signal 167, which is the output from the controller 163, is provided to the subtrahend input of the summing block 222. Signal 127, which is the output from the multiplying block 122, is supplied to the minuend input of the summing block 222. Signal 167 is subtracted from signal 127 to establish signal 223 which is supplied as a first input to the low select 224.

In like manner, signal 179 which is the output from the controller 177, is provided to the subtrahend input of the summing block 226. Signal 132, which is the output from the multiplying block 124, is supplied to the minuend input of the summing block 226. Signal 179 is subtracted from signal 132 to establish signal 227 which is supplied as a second input to the low select 224.

The low select 224 determines which of the signals 223 and 227 is the lowest and establishes a control signal 229 in response to this determination. The control signal 229 is supplied as an actuating signal to the software switch 214.

If signal 223 is lower than signal 227, then signal 118 is set equal to signal 212. However, if signal 227 is the least, then signal 118 is set equal to signal 221.

Essentially, a comparison of signals 223 and 227 determines which of the low selects 131 and 134 has the smallest difference between the input signals to the low selects. It has been found that using a signal having a magnitude equal to the output from the low select which has the least difference between the input signals divided by the bias signal applied to the multiplying block associated with that low select provides excellent anti-reset windup control of the master controller 111.

The invention has been described in terms of a preferred embodiment as illustrated in FIGS. 1–3. Specific components used in the practice of the invention illustrated in FIG. 1 such as pressure transducers 36; flow transducers 41, 51, 46 and 55; flow sensors 42, 52, 47 and 56; flow controllers 45 and 49 and control valves 65 and 68 are each well known, commercially available control components such as are described at length in Perry's Chemical Engineer's Handbook, 4th Edition, Chapter 22, McGraw-Hill.

While the invention has been described in terms of the presently preferred embodiment, reasonable variations and modifications are possible by those skilled in the art. Such variations and modifications are within the scope of the described invention as claimed.

That which is claimed is:

1. Apparatus comprising:

a first burner;

a second burner;

means for providing an offgas from an offgas source to said first burner;

means for providing said offgas from said offgas source to said second burner;

means for providing a first fuel gas to said first burner, wherein the combustion of said offgas and said first fuel gas at said first burner supplies heat to a first process with which said first burner is associated;

means for providing a second fuel gas to said second burner, wherein the combustion of said offgas and said second fuel gas at said second burner supplies heat to a second process with which said second burner is associated;

means for establishing a first signal representative of the actual pressure of said offgas source;

means for establishing a second signal representative of a minimum pressure for said offgas source;

means for comparing said first signal and said second signal and for establishing a third signal which is responsive to the difference between said first signal and said second signal, wherein said third signal is scaled so as to be representative of the total flow rate of offgas to said first burner and said second burner required to maintain the actual pressure of said offgas source substantially equal to the minimum pressure represented by said second signal;

means for establishing a fourth signal in response to said third signal, wherein said fourth signal is representative of the flow rate of offgas to said first burner which, in combination with the flow rate of offgas to said second burner, will maintain the actual pressure of said offgas source substantially equal to the minimum pressure represented by said second signal;

means for establishing a fifth signal in response to said third signal, wherein said fifth signal is representative of the flow rate of offgas to said second burner which, in combination with the flow rate of offgas to said first burner, will maintain the actual pressure of said offgas source substantially equal to the minimum pressure represented by said second signal;

means for establishing a sixth signal representative of the actual ratio of the heat supplied by the combustion of said offgas at said first burner to the total heat supplied by the combustion of said offgas and said first fuel gas at said first burner;

means for establishing a seventh signal representative of the desired ratio of the heat supplied by the combustion of said offgas at said first burner to the total heat supplied by the combustion of said offgas and said first fuel gas at said first burner;

means for comparing said sixth signal and said seventh signal and for establishing an eighth signal which is responsive to the difference between said sixth signal and said seventh signal, wherein said eighth signal is scaled so as to be representative of the flow rate of offgas to said first burner required to maintain the actual ratio represented by said sixth signal substantially equal to the desired ratio represented by said seventh signal;

a first low select;

means for providing said fourth signal and said eighth signal to said first low select, wherein a ninth signal which is representative of the one of said fourth and eighth signals which is representative of the lowest flow rate of offgas to said first burner is established as an output signal from said first low select;

means for manipulating the flow rate of offgas to said first burner in response to said ninth signal;

means for establishing a tenth signal representative of the actual ratio of the heat supplied by the combustion of said offgas at said second burner to the total heat supplied by the combustion of said offgas and said second fuel gas at said second burner;

means for establishing an eleventh signal representative of the desired ratio of the heat supplied by the combustion of said offgas at said second burner to the total heat supplied by the combustion of said offgas and said second fuel gas at said second burner;

means for comparing said tenth signal and said eleventh signal and for establishing a twelfth signal which is responsive to the difference between said tenth signal and said eleventh signal, wherein said twelfth signal is scaled so as to be representative of the flow rate of offgas to said second burner required to maintain the actual ratio represented by said tenth signal substantially equal to the desired ratio represented by said eleventh signal;

a second low select;

means for supplying said fifth signal and said twelfth signal to said second low select, wherein a thirteenth signal which is representative of the one of said fifth and twelfth signals which is representative of the lowest flow rate of offgas to said second burner is established as an output signal from said second low select; and means for manipulating the flow rate of offgas to said second burner in response to said thirteenth signal.

2. Apparatus in accordance with claim 1 wherein said means for establishing said fourth signal and said fifth signal comprises:

means for establishing a first bias signal representative of the percentage of the flow rate of offgas represented by said third signal which should be supplied to said first burner;

means for multiplying said third signal by said first bias signal to establish said fourth signal;

means for establishing a second bias signal representative of the percentage of the flow rate of offgas represented by said third signal which should be supplied to said second burner; and means for multiplying said third signal by said second bias signal to establish said fifth signal, wherein the sum of said first bias signal and said second bias signal is equal to 100%.

3. Apparatus in accordance with claim 2 wherein said first fuel gas and said second fuel gas are the same and wherein said means for establishing said sixth signal and said tenth signal comprises:

means for establishing a fourteenth signal representative of the actual flow rate of said offgas to said first burner;

means for establishing a fifteenth signal representative of the actual flow rate of said offgas to said first burner in standard cubic feet per hour in response to said fourteenth signal and said first signal;

means for establishing a sixteenth signal representative of the number of BTUs contained in each standard cubic foot of said offgas;

means for multiplying said fifteenth signal by said sixteenth signal to establish a seventeenth signal representative of the total heat being supplied by the combustion of said offgas at said first burner;

means for establishing an eighteenth signal representative of the actual flow rate of said first fuel gas;

means for establishing a nineteenth signal representative of the number of BTUs contained in each standard cubic foot of said first fuel gas;

means for multiplying said eighteenth signal by said nineteenth signal to establish a twentieth signal representative of the total heat supplied by the combustion of said first fuel gas at said first burner;

means for summing said seventeenth signal and said twentieth signal to establish a twenty first signal representative of the total heat supplied by the combustion of said offgas and said first fuel gas at said first burner;

means for dividing said seventeenth signal by said twenty first signal to establish said sixth signal;

means for establishing a twenty-second signal representative of the actual flow rate of said offgas to said second burner;

means for establishing a twenty-third signal representative of the actual flow rate of said offgas to said second burner in standard cubic feet per hour in response to said twenty-second signal and said first signal;

means for multiplying said twenty-third signal by said sixteenth signal to establish a twenty-fourth signal representative of the total heat being supplied by the combustion of said offgas at said second burner;

means for establishing a twenty-fifth signal representative of the actual flow rate of said second fuel gas;

means for multiplying said twenty-fifth signal by said nineteenth signal to establish a twenty-sixth signal representative of the total heat supplied by the combustion of said second fuel gas at said second burner;

means for summing said twenty-fourth signal and said twenty-sixth signal to establish a twenty-seventh signal representative of the total heat supplied by the combustion of said offgas and said second fuel gas at said second burner; and means for dividing said twenty-fourth signal by said twenty-seventh signal to establish said tenth signal.

4. Apparatus in accordance with claim 2 wherein said means for comparing said first signal and said second signal is a controller having a select input and wherein said apparatus additionally comprises:

means for dividing said ninth signal by said first bias signal to establish a fourteenth signal;

means for dividing said thirteenth signal by said second bias signal to establish a fifteenth signal;

means for establishing a sixteenth signal representative of the difference between said fourth signal and said eighth signal;

means for establishing a seventeenth signal representative of the difference between said twelfth signal and said fifth signal; and means for establishing an anti-reset windup signal and for supplying said anti-reset windup signal to the select input of said controller so as to prevent reset windup of said controller, wherein said anti-reset windup signal has a magnitude equal to the magnitude of said fourteenth signal if the magnitude of said sixteenth signal is less than the magnitude of said seventeenth signal and wherein said anti-reset windup signal has a magnitude equal to the magnitude of said fifteenth signal if the magnitude of said seventeenth signal is less than the magnitude of said sixteenth signal.

5. Apparatus in accordance with claim 1 wherein said first process is a first boiler and wherein said second process is a second boiler.

6. A method for controlling the flow of an offgas from an offgas source to a first burner associated with a first process and a second burner associated with a second process, wherein the combustion of said offgas and a first fuel gas at said first burner supplies heat to said first process and wherein the combustion of said offgas and a second fuel gas at said second burner supplies heat to said second process, said method comprising the steps of:

establishing a first signal representative of the actual pressure of said offgas source;

establishing a second signal representative of a minimum pressure for said offgas source;

comparing said first signal and said second signal and establishing a third signal which is responsive to the difference between said first signal and said second signal, wherein said third signal is scaled so as to be representative of the total flow rate of offgas to said first burner and said second burner required to maintain the actual pressure of said offgas source substantially equal to the minimum pressure represented by said second signal;

establishing a fourth signal in response to said third signal, wherein said fourth signal is representative of the flow rate of offgas to said first burner which, in combination with the flow rate of offgas to said second burner, will maintain the actual pressure of said offgas source substantially equal to the minimum pressure represented by said second signal;

establishing a fifth signal in response to said third signal, wherein said fifth signal is representative of the flow rate of offgas to said second burner which, in combination with the flow rate of offgas to said first burner, will maintain the actual pressure of said offgas source substantially equal to the minimum pressure represented by said second signal;

establishing a sixth signal representative of the actual ratio of the heat supplied by the combustion of said offgas at said first burner to the total heat supplied by the combustion of said offgas and said first fuel gas at said first burner;

establishing a seventh signal representative of the desired ratio of the heat supplied by the combustion of said offgas at said first burner to the total heat supplied by the combustion of said offgas and said first fuel gas at said first burner;

comparing said sixth signal and said seventh signal and establishing an eighth signal which is responsive to the difference between said sixth signal and said seventh signal, wherein said eighth signal is scaled so as to be representative of the flow rate of offgas to said first burner required to maintain the actual ratio represented by said sixth signal substantially equal to the desired ratio represented by said seventh signal;

establishing a ninth signal which is representative of the one of said fourth and eighth signals which is representative of the lowest flow rate of offgas to said first burner;

manipulating the flow rate of offgas to said first burner in response to said ninth signal;

establishing a tenth signal representative of the actual ratio of the heat supplied by the combustion of said offgas at said second burner to the total heat supplied by the combustion of said offgas and said second fuel gas at said second burner;

establishing an eleventh signal representative of the desired ratio of the heat supplied by the combustion of said offgas at said second burner to the total heat supplied by the combustion of said offgas and said second fuel gas at said second burner;

comparing said tenth signal and said eleventh signal and establishing a twelfth signal which is responsive to the difference between said tenth signal and said eleventh signal, wherein said twelfth signal is scaled so as to be representative of the flow rate of offgas to said second burner required to maintain the actual ratio represented by said tenth signal substantially equal to the desired ratio represented by said eleventh signal;

establishing a thirteenth signal which is representative of the one of said fifth and twelfth signals which is representative of the lowest flow rate of offgas to said second burner; and manipulating the flow rate of offgas to said second burner in response to said thirteenth signal.

7. A method in accordance with claim 6 wherein said step of establishing said fourth signal and said fifth signal comprises:

establishing a first bias signal representative of the percentage of the flow rate of offgas represented by said third signal which should be supplied to said first burner;

multiplying said third signal by said first bias signal to establish said fourth signal;

establishing a second bias signal representative of the percentage of the flow rate of offgas represented by said third signal which should be supplied to said second burner; and multiplying said third signal by said second bias signal to establish said fifth signal, wherein the sum of said first bias signal and said second bias signal is equal to 100%.

8. A method in accordance with claim 7 wherein said first fuel gas and said second fuel gas are the same and wherein said step of establishing said sixth signal and said tenth signal comprises:

establishing a fourteenth signal representative of the actual flow rate of said offgas to said first burner;

establishing a fifteenth signal representative of the actual flow rate of said offgas to said first burner in standard cubic feet per hour in response to said fourteenth signal and said first signal;

establishing a sixteenth signal representative of the number of BTUs contained in each standard cubic foot of said offgas;

multiplying said fifteenth signal by said sixteenth signal to establish a seventeenth signal representative of the total heat being supplied by the combustion of said offgas at said first burner;

establishing an eighteenth signal representative of the actual flow rate of said first fuel gas;

establishing a nineteenth signal representative of the number of BTUs contained in each standard cubic foot of said first fuel gas;

multiplying said eighteenth signal by said nineteenth signal to establish a twentieth signal representative of the total heat supplied by the combustion of said first fuel gas at said first burner;

summing said seventeenth signal and said twentieth signal to establish a twenty first signal representative of the total heat supplied by the combustion of said offgas and said first fuel gas at said first burner;

dividing said seventeenth signal by said twenty first signal to establish said sixth signal;

establishing a twenty-second signal representative of the actual flow rate of said offgas to said second burner;

establishing a twenty-third signal representative of the actual flow rate of said offgas to said second burner in standard cubic feet per hour in response to said twenty-second signal and said first signal;

multiplying said twenty-third signal by said sixteenth signal to establish a twenty-fourth signal representative of the total heat being supplied by the combustion of said offgas at said second burner;

establishing a twenty-fifth signal representative of the actual flow rate of said second fuel gas;

multiplying said twenty-fifth signal by said nineteenth signal to establish a twenty-sixth signal representative of the total heat supplied by the combustion of said second fuel gas at said second burner;

summing said twenty-fourth signal and said twenty-sixth signal to establish a twenty-seventh signal representative of the total heat supplied by the combustion of said offgas and said second fuel gas at said second burner; and dividing said twenty-fourth signal by said twenty-seventh signal to establish said tenth signal.

9. A method in accordance with claim 7 wherein is a controller having a select input is utilized to compare said first signal and said second signal and wherein said method additionally comprises the steps of:

dividing said ninth signal by said first bias signal to establish a fourteenth signal;

dividing said thirteenth signal by said second bias signal to establish a fifteenth signal;

establishing a sixteenth signal representative of the difference between said fourth signal and said eighth signal;

establishing a seventeenth signal representative of the difference between said twelfth signal and said fifth signal; and establishing an anti-reset windup signal and supplying said anti-reset windup signal to the select input of said controller so as to prevent reset windup of said controller, wherein said anti-reset windup signal has a magnitude equal to the magnitude of said fourteenth signal if the magnitude of said sixteenth signal is less than the magnitude of said seventeenth signal and wherein said anti-reset windup signal has a magnitude equal to the magnitude of said fifteenth signal if the magnitude of said seventeenth signal is less than the magnitude of said sixteenth signal.

10. A method in accordance with claim 6 wherein said first process and said second process are processes for generating steam.

* * * * *